US011285532B2

(12) United States Patent
Hong et al.

(10) Patent No.: US 11,285,532 B2
(45) Date of Patent: Mar. 29, 2022

(54) BORON-NITRIDE NANOPLATELET(S)/METAL NANOCOMPOSITE POWDER AND PREPARING METHOD THEREOF

(71) Applicant: Korea Advanced Institute of Science and Technology, Guseong-dong (KR)

(72) Inventors: Soon Hyung Hong, Guseong-dong (KR); Sung Chan Yoo, Guseong-dong (KR); Jun Ho Lee, Guseong-dong (KR); Hee Su Byeon, Guseong-dong (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 270 days.

(21) Appl. No.: 16/467,491

(22) PCT Filed: Jan. 23, 2019

(86) PCT No.: PCT/KR2019/000954
§ 371 (c)(1),
(2) Date: Jun. 6, 2019

(87) PCT Pub. No.: WO2019/198918
PCT Pub. Date: Oct. 17, 2019

(65) Prior Publication Data

US 2020/0269314 A1 Aug. 27, 2020

(30) Foreign Application Priority Data

Apr. 12, 2018 (KR) ..... 10-2018-0042691

(51) Int. Cl.
*B22F 1/00* (2006.01)
*B22F 9/18* (2006.01)

(52) U.S. Cl.
CPC ..... *B22F 1/0044* (2013.01); *B22F 9/18* (2013.01); *B22F 2301/10* (2013.01);
(Continued)

(58) Field of Classification Search
CPC ..... B22F 1/0044; B22F 2302/205; B22F 9/18
See application file for complete search history.

(56) References Cited

U.S. PATENT DOCUMENTS 9,211,586 B1 12/2015 Lavernia et al.
2011/0256014 A1* 10/2011 Hong ..... C22C 26/00 419/11

(Continued)

FOREIGN PATENT DOCUMENTS

CN 102218540 A 10/2011
CN 103203462 A 7/2013

(Continued)

OTHER PUBLICATIONS

Office Action of Chinese Patent Application No. 201980000444.6—8 pages (dated Apr. 1, 2021).

(Continued)

*Primary Examiner* — Anthony J Zimmer
*Assistant Examiner* — Ricardo D Morales
(74) *Attorney, Agent, or Firm* — Knobbe Martens Olson & Bear LLP

(57) ABSTRACT

Provided are a boron-nitride nanoplatelet(s) (BNNP)/metal nanocomposite powder and a preparing method thereof, the BNNP/metal nanocomposite powder including a base metal and BNNP dispersed in the base metal and configured to serve as a reinforcement of the base metal, wherein the BNNP are interposed between metal particles of the base metal in the form of a thin film of a plurality of layers and (Continued)

combined with the metal particles, and an amount of the BNNP in the base metal is greater than 0 vol % and less than 90 vol %.

8 Claims, 10 Drawing Sheets

(52) U.S. Cl.
CPC ..... *B22F 2302/20* (2013.01); *B22F 2302/205* (2013.01); *B22F 2302/25* (2013.01); *B22F 2304/052* (2013.01); *B22F 2304/054* (2013.01)

(56) References Cited

U.S. PATENT DOCUMENTS

| | | | | |
|---|---|---|---|---|
| 2014/0373965 | A1 | 12/2014 | Leist | |
| 2016/0276056 | A1* | 9/2016 | Stolyarov | C08J 3/11 |
| 2017/0275742 | A1* | 9/2017 | Ganor | C22C 38/105 |

FOREIGN PATENT DOCUMENTS

| | | | |
|---|---|---|---|
| CN | 103317143 | A | 9/2013 |
| CN | 105948517 | A | 9/2016 |
| CN | 106747530 | A | 5/2017 |
| KR | 20110065288 | A | 6/2011 |
| KR | 20110115085 | A | 10/2011 |
| KR | 10-1144884 | B1 | 5/2012 |
| KR | 20150028745 | A | 3/2015 |
| WO | 2017013263 | A1 | 1/2017 |

OTHER PUBLICATIONS

Cui et al., "Non-covalent functionalized hexagon boron nitride nanoplatelets to improve corrosion and wear resistance of epoxy coatings" Royal Society of Chemistry—Sep. 12, 2017, 18 pages.

* cited by examiner

BORON-NITRIDE NANOPLATELET(S)/METAL NANOCOMPOSITE POWDER AND PREPARING METHOD THEREOF

TECHNICAL FIELD

Embodiments of the present invention relate to a boron-nitride nanoplatelet(s) (BNNP)/metal nanocomposite powder and a preparing method thereof.

BACKGROUND ART

Metals are materials with excellent strengths and excellent thermal and electrical conductivities. Further, due to great ductility, metals are relatively easy to process when compared to other materials and thus, are applied throughout industries for multiple purposes. In recent years, studies have been conducted actively to prepare metal nanocomposite powders having high industrial applicability by incorporating nanotechnology into metals.

In the study of metal nanocomposite powders, in addition to properties of metals, mechanical properties newly emerging as the particle size of the metals becomes finer attract attention. In particular, various functionalities expected by nanomaterials in addition to metal particles may be additionally secured. Thus, new properties caused by interparticle interactions, volume effects, and surface effects are expected to be applied to high-temperature structural materials, tool materials, electromagnetic materials, filters, and sensors as advanced materials.

In such metal nanopowders, studies have been conducted to add new functions while maintaining properties of the existing metal powders or to improve mechanical and electrical properties of the existing metal powders. In particular, there is a growing interest in composite powder materials with improved mechanical and electrical properties when compared to the existing metal powders by dispersing inorganic materials.

In recent years, studies have been conducted by utilizing carbon-based nanomaterials such as graphene or carbon nanotubes (CNT), in metal nanocomposite materials among various materials. However, such carbon-based nanomaterials have relatively low stabilities at high temperature, and the nanomaterials themselves have significantly low expected physical properties due to functional grouping and many defects occurring in the preparing process. Thus, there is an increasing demand for a new material applicable as a reinforcement to solve the foregoing issues.

DISCLOSURE OF INVENTION

Technical Goals

An aspect of the present invention provides a boron-nitride nanoplatelet(s) (BNNP)/metal nanocomposite powder to which BNNP are applied.

An aspect of the present invention provides a method of preparing the BNNP/metal nanocomposite powder.

Technical Solutions

According to an aspect of the present invention, there is provided a boron-nitride nanoplatelet(s) (BNNP)/metal nanocomposite powder including a base metal, and BNNP dispersed in the base metal and configured to serve as a reinforcement of the base metal, wherein the BNNP may be interposed between metal particles of the base metal in the form of a thin film of a plurality of layers and combined with the metal particles, and an amount of the BNNP in the base metal may be greater than 0 vol % and less than 90 vol %.

The metal particles may have the size of 1 nm to 50 μm.

The BNNP may have the thickness of 0.5 nm to 100 nm and the size of 1.5 μm to 10 μm.

The base metal may include at least one of alkali metals, alkaline earth metals, transition metals, post-transition metals, and metalloids.

According to an aspect of the present invention, there is provided a method of preparing a BNNP/metal nanocomposite powder, the method including acquiring a nanocomposite powder by dispersing a BNNP powder within a base metal.

The base metal may include at least one of alkali metals, alkaline earth metals, transition metals, post-transition metals, and metalloids.

The acquiring may include dispersing BNNP into a solvent, providing a metal salt to be applied as the base metal to the BNNP-dispersed solvent, and forming a powder in which the BNNP are dispersed in the form of a thin film of a plurality of layers between metal particles of the base metal by reducing the BNNP and the metal salt.

The forming may include returning the BNNP functional group material and the metal salt together with a reduction atmosphere or a reducer.

The acquiring may include dispersing BNNP into a solvent, providing a metal salt to be applied as the base metal to the BNNP-dispersed solvent, forming a metallic oxide by oxidizing the metal salt in the solvent, and forming a powder in which the BNNP are dispersed in the form of a thin film of a plurality of layers between metal particles of the base metal by reducing the BNNP and the metallic oxide.

The forming of the metallic oxide may include performing a heat treatment after providing an oxidizer to the solvent including the BNNP and the metal salt.

The forming of the powder may include performing a heat treatment on a composite powder including the BNNP and the metallic oxide in a reduction atmosphere.

The method may further include forming a bulk material by sintering a BNNP/metal nanocomposite powder obtained during the acquiring of the nanocomposite powder at room temperature to a temperature of 90% of a melting point of the base metal.

It should be understood that effects achievable through embodiments set forth herein are not limited to the above effects and include all effects that can be deduced from the configuration described in the following description or the scope of the claims.

According to embodiments, it is possible to provide a boron-nitride nanoplatelet(s) (BNNP)/metal nanocomposite powder with improved mechanical strength, electrical conductivity, or thermal conductivity by dispersing BNNP as a reinforcement in a base metal.

According to embodiments, it is possible to uniformly disperse BNNP in a base material including an alloy or nano-metal particles through molecular level or mechanical milling, and to provide a BNNP/metal nanocomposite powder with enhanced mechanical properties when compared to the existing metals or alloys.

BEST MODE FOR CARRYING OUT THE INVENTION

Figure 1A:
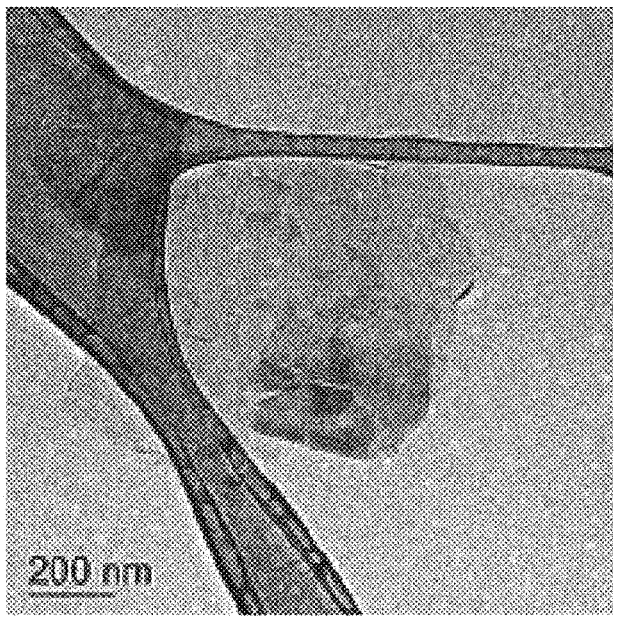
FIG. 1A illustrates a Transmission Electron Microscope (TEM) image of boron-nitride nanoplatelet(s) (BNNP) prepared in Preparation Example according to an embodiment.

Hereinafter, examples will be described in detail with reference to the accompanying drawings. However, various alterations and modifications may be made to the examples. Here, the examples are not construed as limited to the disclosure and should be understood to include all changes, equivalents, and replacements within the idea and the technical scope of the disclosure.

The terminology used herein is for the purpose of describing particular examples only and is not to be limiting of the examples. As used herein, the singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which examples belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the examples with reference to the accompanying drawings, like reference numerals refer to like constituent elements and a repeated description related thereto will be omitted. In the description of examples, detailed description of well-known related structures or functions will be omitted when it is deemed that such description will cause ambiguous interpretation of the present disclosure.

According to an embodiment, there is provided a boron nitride nanoplatelet(s) BNNP/metal nanocomposite powder which includes a base metal and a reinforcement dispersed in the base metal and may provide improved mechanical, electrical, and thermal properties.

The reinforcement may include BNNP. The BNNP is a material having a hexagonal system structure, in which boron atoms and nitrogen atoms are provided in a planar two-dimensional (2D) hexagonal structure, the material with high physical and chemical stability. Further, the BNNP has excellent mechanical and thermal properties and thus, has an excellent thermal stability at high temperature. For example, the BNNP is stable up to 3000° C. in an inert atmosphere, has a high thermal shock resistance due to its thermal conductivity as high as that of stainless steel, is not cracked or damaged despite of repetition of rapid heating and rapid cooling of about 1500° C., and has excellent high-temperature lubricative characteristic and corrosion resistance. In addition, due to the characteristics described above, the BNP may be applied as a reinforcement to improve properties of a nanocomposite powder. For example, the BNNP may be interposed between metal particles of the base metal in the form of a thin film of a plurality of layers and combined with the metal particles, thereby improving the properties of the nanocomposite powder.

The BNNP may be included within a range which may prevent a structural deformation caused by a reaction between the BNNP within the base metal. For example, an amount of the BNNP in the base metal may be greater than 0 vol % and less than 90 vol %.

The BNNP may include a plurality of layers, preferably, 3 to 10 layers to reduce a structural defect and an interfacial resistance. Further, the BNNP may have various forms, for example, the form of a thin film.

The BNNP may have the thickness of 0.5 nm to 100 nm and the size of 1.5 μm to 10 μm, and if included in the thickness and size range, the BNNP may be dispersed well in the base metal, whereby the nanocomposite powder with improved mechanical strength, electrical conductivity, and thermal conductivity may be provided.

The metal particles may include at least one of alkali metals, alkaline earth metals, transition metals, post-transition metals, and metalloids. For example, the metal particles may include at least one of nickel, cobalt, molybdenum, iron, potassium, ruthenium, chromium, gold, silver, aluminum, magnesium, titanium, tungsten, lead, zirconium, zinc, and platinum. Further, the metal particles may be an alloy including at least one of the above-mentioned metals, for example, SUS400 series stainless steel, ASTM 52100, SUJ-2, or in detail, SUS400C.

The metal particles may have the size of 1 nm to 50 μm, and the size may be the diameter, the length, the thickness, or the height depending on the form of the particles.

The BNNP/metal nanocomposite powder may provide improved mechanical properties of about 101 to 200% of the young's modulus, 101 to 300% of the yield strength, and 101 to 200% of the tensile strength, when compared to a pure base metal.

According to an embodiment, there is provided a method of preparing a BNNP/metal nanocomposite powder, in detail, the method including acquiring a nanocomposite powder by dispersing a BNNP powder within a base metal.

In the method, the dispersed BNNP may serve as a reinforcement of the base metal, and the dispersed BNNP may be controlled to be greater than 0 vol % and less than 90 vol %.

The acquiring of the nanocomposite powder may be performed using a mechanical mixing process and a molecular level mixing process. When the mechanical mixing process is used, the acquiring of the nanocomposite powder may include preparing a base metal powder, and mixing the BNNP powder and the base metal powder using a ball mill.

In the preparing of the base metal powder, the base metal may be a metal or an alloy including at least one of alkali metals, alkaline earth metals, transition metals, post-transition metals, and metalloids.

The BNNP powder to be applied as a reinforcement of the nanocomposite powder may be prepared and used, and the preparing of the base metal powder may include, for example, forming a slurry by mixing hexagonal boron nitride (h-BN) particles and a NaOH aqueous solution, ball-milling the slurry using a stainless steel ball, removing impurities by adding an acid to the slurry and performing a sonication thereon, and acquiring a solid from the slurry and washing the solid after the removing of the impurities. The removing of the impurities may be performed using an acid or an acidic aqueous solution including at least one of nitric acid, hydrochloric acid, sulfuric acid, and acetic acid.

The mixing of the BNNP powder and the base metal powder using the ball mill may be performed by mixing the powder through ball milling for 1 to 10 hours at 50 rpm or higher, 50 rpm to 500 rpm, or 10 rpm to 200 rpm, wherein a mixing ratio (w/w) of the stainless ball:the whole powder may be 50:0.5 to 2.

When the molecular level mixing process is used, the acquiring of the nanocomposite powder may include dispersing BNNP into a solvent, providing a metal salt to be applied as the base metal to the BNNP-dispersed solvent, and forming a powder in which the BNNP are dispersed in the form of a thin film of a plurality of layers between metal particles of the base metal by reducing the BNNP and the metal salt.

In the providing of the metal salt, the metal salt may include at least one of carbonates, chlorides, fluorides, nitrates, sulphates, nitrates, and oxalates.

The forming of the powder in which the BNNP are dispersed may be returning the BNNP functional group material and the metal salt together with a reduction atmosphere or a reducer. The reduction atmosphere may include at least one reducing gas of hydrogen (H2), hydrocarbons (CH4), and carbon monoxide (CO), and the forming of the powder in which the BNNP are dispersed may be performed for 30 minutes to 10 hours at a temperature of 100° C. or higher, or 100° C. to 500° C. in a reduction atmosphere in which the reducing gas and an inert gas such as Ar or He are mixed.

When the molecular level mixing process is used, the acquiring of the nanocomposite powder may include dispersing BNNP into a solvent, providing a metal salt to be applied as the base metal to the BNNP-dispersed solvent, forming a metallic oxide by oxidizing the metal salt in the solvent, and forming a powder in which the BNNP are dispersed in the form of a thin film of a plurality of layers between metal particles of the base metal by reducing the BNNP and the metallic oxide.

The forming of the metallic oxide may be performing a heat treatment after providing an oxidizer to the solvent including the BNNP and the metal salt. The forming of the metallic oxide may be performed by performing a heat treatment for 30 minutes to hours at a temperature of 100° C. to 500° C. after providing the oxidizer. The oxidizer may include NaOH, KOH, or both.

The method may further include forming a bulk material, and the forming of the bulk material may be forming the bulk material by sintering a BNNP/metal nanocomposite powder obtained during the acquiring of the nanocomposite powder at room temperature to a temperature of 90% of a melting point of the base metal.

The room temperature to the temperature of 90% of the melting point of the base material may be room temperature to 2000° C., or 100° C. to 1000° C., and the sintering may be performed for 1 minute or longer, 1 minute to 30 minutes, or 1 minute to 20 minutes at the above temperature. If included in the temperature and time range, an appropriate combination of the base metal and the BNNP may be induced, and a nanocomposite material with improved mechanical and thermal properties may be provided. Further, the sintering of the powder may be performed by heating the powder at a heating rate of 50 to 200° C./min.

Preparation Example

Synthesis of BNNP

Figure 1B:
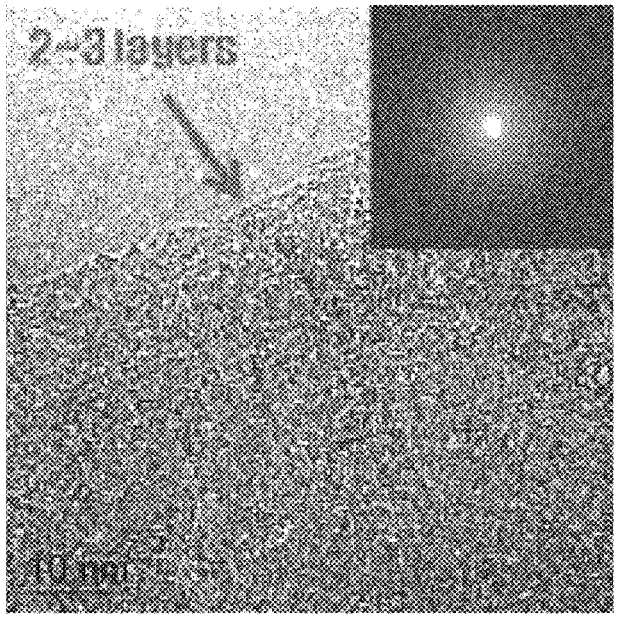
FIG. 1B illustrates a TEM image of BNNP prepared in Preparation Example according to an embodiment.
Figure 1C:
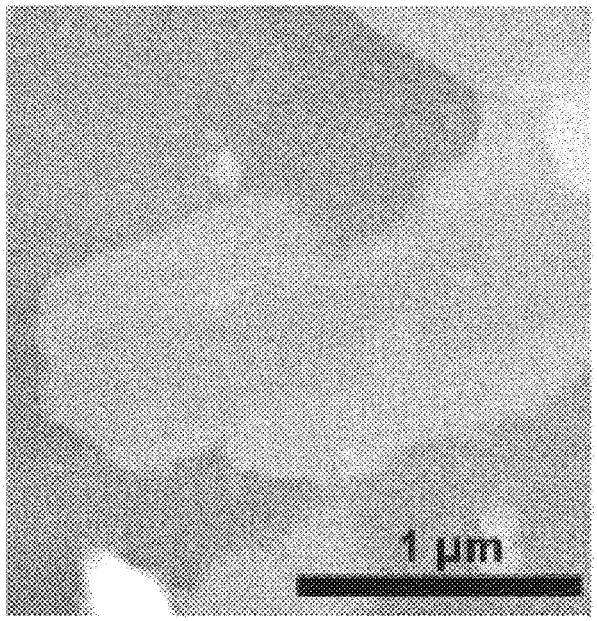
FIG. 1C illustrates a TEM image of BNNP prepared in Preparation Example according to an embodiment.

A slurry was prepared by mixing 2 g of h-BN (hexagonal boron nitride) particles and 20 ml of an NaOH aqueous solution (concentration: 2 M), and ball-milled (50:1 ball to powder ratio, 100 g SUS ball) at 200 rpm and for 24 hours. Then, the slurry was filled with 800 mL of distilled water, 200 mL of HCl was added, and impurities were removed by performing a sonication. A solid of the slurry was filtered, washed with water, then dispersed again by performing a sonication in IPA for 1 hour, centrifuged at 2000 rpm and for 30 minutes, filtered, and dried. Transmission Electron Microscope (TEM) images of the obtained BNNP are shown in FIGS. 1A through 1C. FIGS. 1A through 1C teach that the BNNP has the average size of 1.5 μm and the average thickness of 2 nm, and has 2 to 3 layers.

Example 1

Preparation of Nanocomposite Powder

An aqueous dispersion of BNNP was prepared by dispersing the BNNP obtained in Preparation Example in distilled water, and mixed with a Cu(II) acetate aqueous solution. Then, a composite powder of copper oxide and BNNP was formed by adding NaOH to the mixture and oxidizing the same at 80° C. The powder was filtered in a vacuum and washed. Then, a reducing process was performed at a temperature of 450° C. and for 3 hours in a reducing furnace of an H2 gas atmosphere, whereby 1, 1.5, 2, 2.5 and 3 vol % BNNP/Cu nanocomposite powders were obtained respectively.

Sintering of Nanocomposite Powder

Figure 2A:
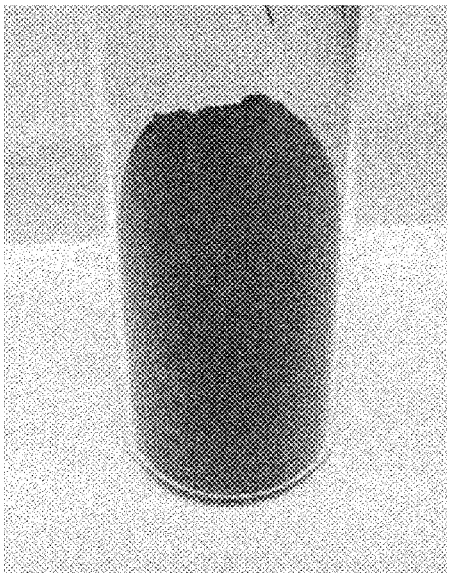
FIG. 2A illustrates an image of a sintered body of a BNNP/Cu nanocomposite powder prepared in Example 1 according to an embodiment.
Figure 2B:
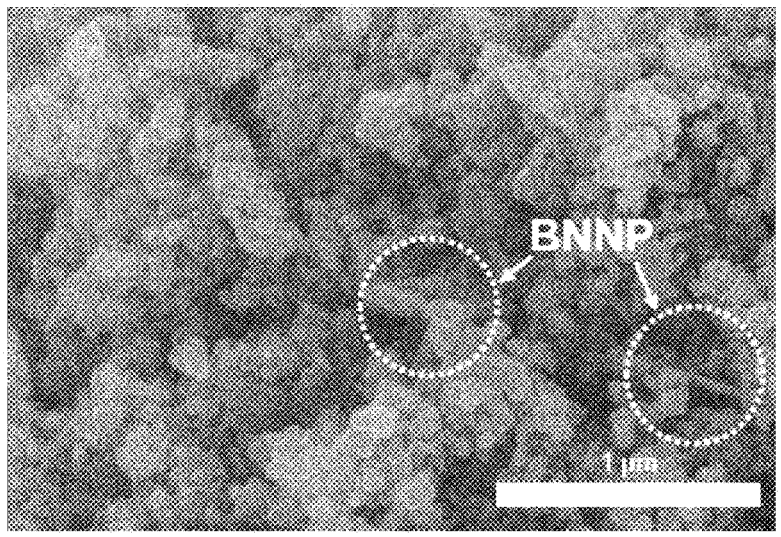
FIG. 2B illustrates a Scanning Electron Microscope (SEM) image of a sintered body of a BNNP/Cu nanocomposite powder prepared in Example 1 according to an embodiment.

The BNNP/Cu nanocomposite powder was sintered through spark plasma sintering at 950° C. and for 5 minutes. An image and a Scanning Electron Microscope (SEM) image of the powder sintered body are illustrated in FIGS. 2A and 2B, respectively. FIGS. 2A and 2B teach that a structure is dispersed and inserted into the BNNP (size: 1 to 2.5 um (length)×20~100 nm (thickness)) within a Cu matrix (metal particle size: 20~100 nm) in the 3 vol % BNNP/Cu nanocomposite powder.

Example 2

Preparation of Nanocomposite Powder

BNNP (235.5 mg) and 29.746 g of SUS440C powder (particle size: 1~50 um) were mixed and ball-milled (50:1 ball to powder ratio, 100 g SUS ball) at 100 rpm and for 1 hour. Then, a BNNP/SUS440C nanocomposite powder was acquired.

Sintering of Nanocomposite Powder

The BNNP/SUS440C nanocomposite powder was sintered through spark plasma sintering at 950° C. and for 5 minutes, as in Example 1.

Comparative Example 1

In the same manner as in Example 1, except that graphene was applied, a 3 vol % graphene/Cu nanocomposite powder was obtained and sintered.

Electrical Property Evaluation

The sintered bodies of the 3 vol % graphene/Cu nanocomposite powder of Comparative Example 1 and the 3 vol % BNNP/Cu nanocomposite powder of Example 1 were used, and electrical properties thereof were measured using a 4-point probe after polishing the sintered bodies to the thickness of 1 um.

(2) Thermal Conductivity Evaluation

Figure 3:
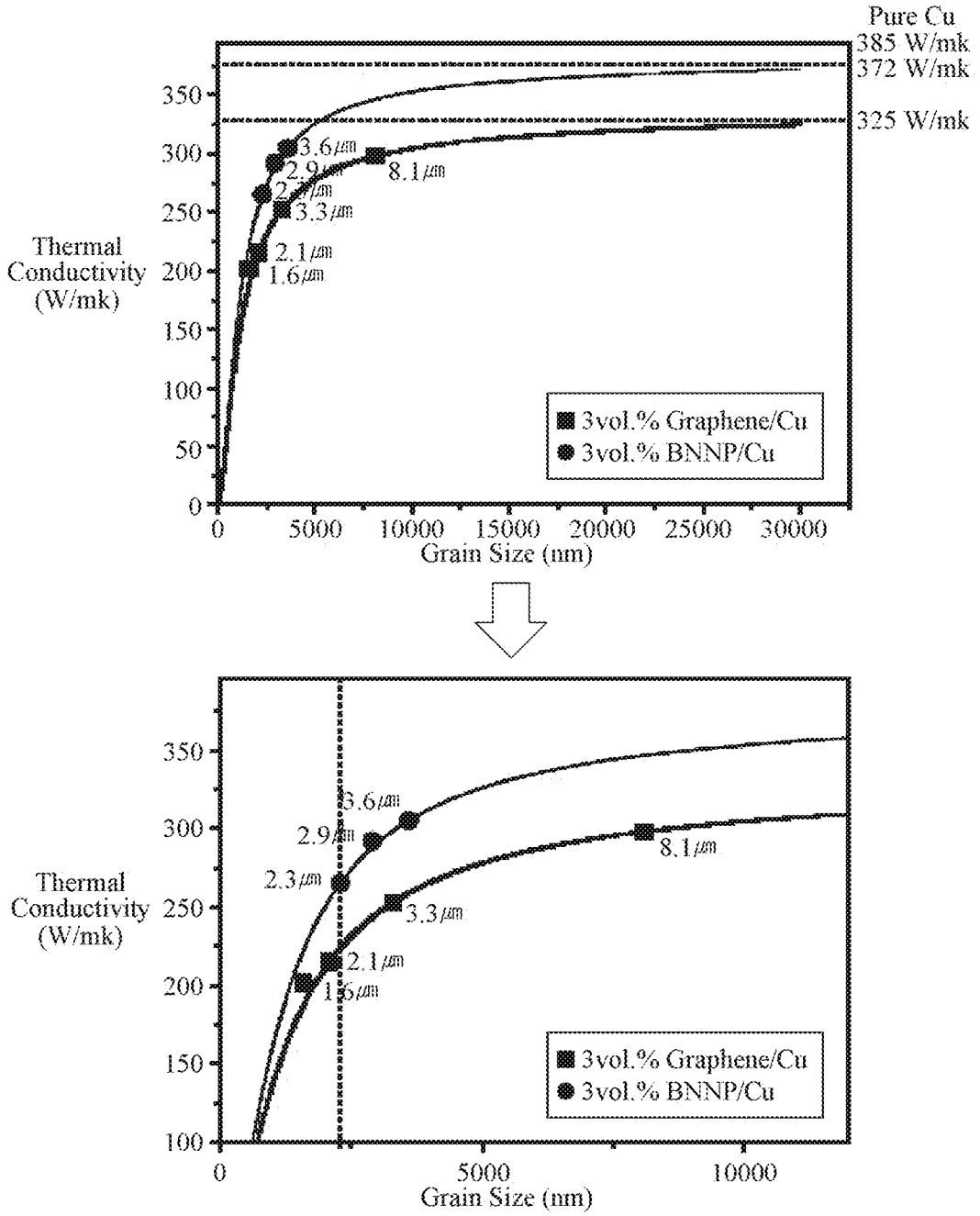
FIG. 3 illustrates a result of evaluating a thermal conductivity of a sintered body of a BNNP/Cu nanocomposite powder manufactured in Example 1 according to an embodiment.

Thermal conductivities of respective specimens in different grain sizes were measured by growing gains. Corresponding results are shown in FIG. 3. The specimen of the composite powder of Example 1 shows the result according to the Kapitza grain size depending on a thermal conductivity mode. That is, it may be learned that the specimen of the composite powder (3 vol %) of Example 1 according to the Kapitza model has a thermal conductivity of about 80% when compared to the generally known copper (annealed copper) in a small gain size (3.6 um), and may be predicted to have a thermal conductivity of about 85% when the grain size increases, similar to the copper (annealed copper).

Further, in a large grain size, the specimen of the composite powder (3 vol %) of Example 1 shows a loss of 3%, whereas the graphene/Cu specimen shows a loss of 17%. That is, a decrease in the interfacial resistance may be induced by relatively fewer functions groups when compared to graphene by addition of BNNP, whereby the thermal conductivity may improve.

(2) Electrical Conductivity Evaluation

Electrical conductivities of respective specimens in different grain sizes were measured by growing grains. Corresponding results are shown in Table 1 and FIG. 4.

Figure 4:
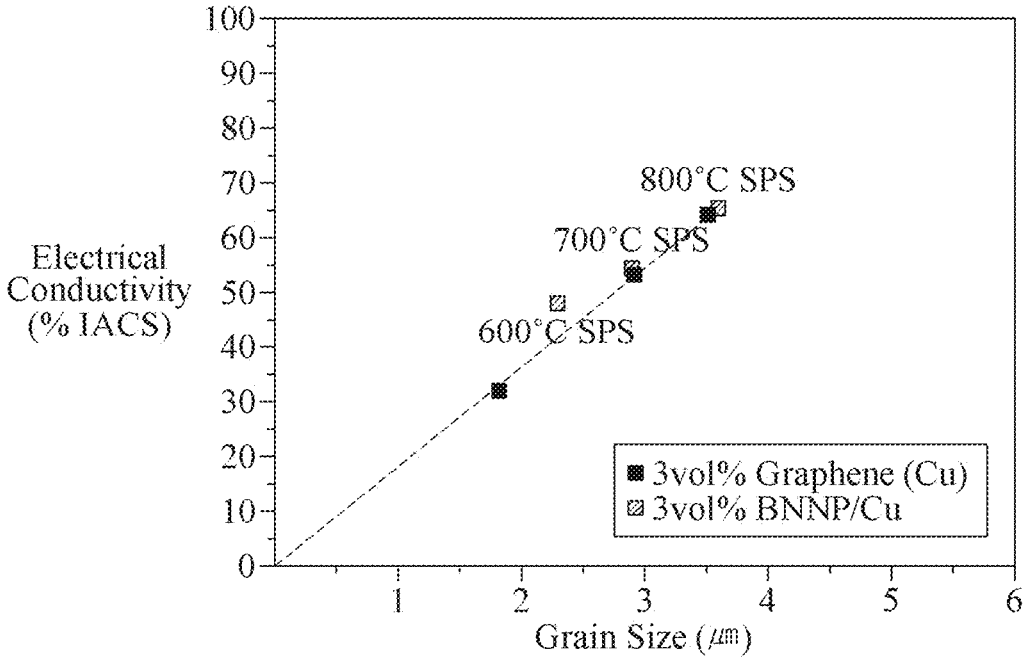
FIG. 4 illustrates a result of evaluating an electrical conductivity of a sintered body of a BNNP/Cu nanocomposite powder prepared in Example 1 according to an embodiment.

Referring to Table 1 and FIG. 4, the electrical conductivity of the specimen of the composite powder of Example 1 increases in response to an increase in the grain size, which is a characteristic similar to that of the specimen of graphene/Cu. That is, in terms of the electrical conductivity, the BNNP act as a nonconductor (that is, electrical conductivity: nonconductor and thermal conductivity: 1700~2000 W/m·k). However, it may be learned that the BNNP maintains a high electrical conductivity of about 65% of IACS if manufactured as a BNNP/Cu nanocomposite powder.

TABLE 1

| | Electrical conductivity (% IACS) | Grain size (μm) |
|---|---|---|
| graphene/Cu | 31.5 | 1.82 |
| graphene/Cu | 53 | 3.52 |
| graphene/Cu | 64 | 2.92 |
| BNNP/Cu | 48 | 2.3 |
| BNNP/Cu | 54 | 2.9 |
| BNNP/Cu | 65 | 3.6 |

(3) Mechanical Property Evaluation

Specimens were prepared by modeling the 3 vol % BNNP/Cu nanocomposite powder of Example 1 and the 1 vol % BNNP/Cu nanocomposite powder and a powder of pure Cu into pellets and then performing spark plasma sintering thereon at 950° C. and for 5 minutes. Stresses and strains were measured and shown in Table 2 and FIG. 5.

Figure 5:
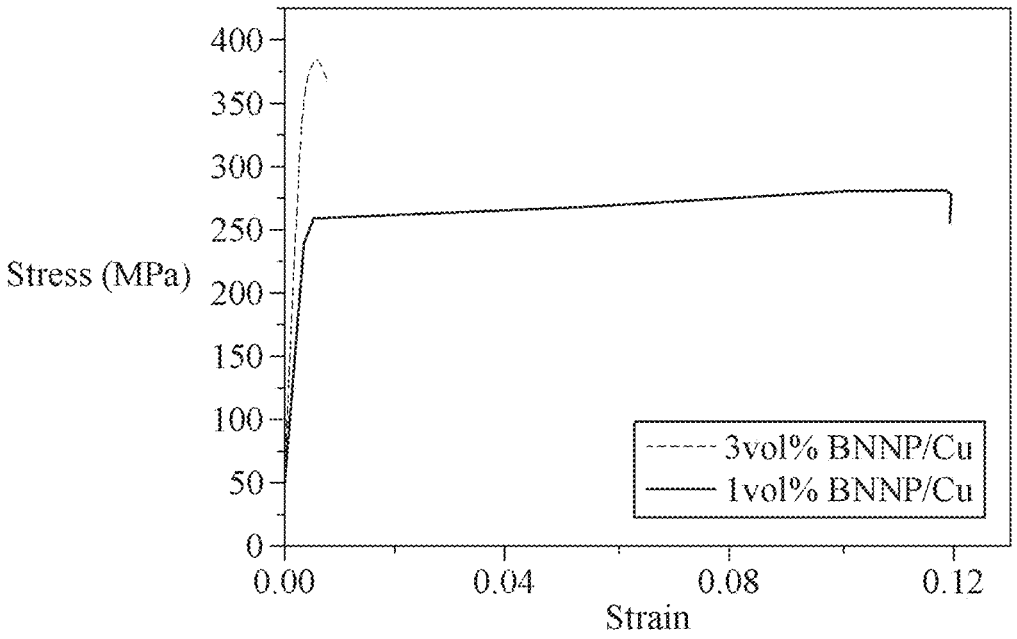
FIG. 5 illustrates a result of evaluating a mechanical property of a sintered body of a BNNP/Cu nanocomposite powder prepared in Example 1 according to an embodiment.

Referring to Table 2 and FIG. 5, it may be learned that the specimen of 3 vol % BNNP/Cu shows a relatively low strain at a high stress, and the 1 vol % BNNP/Cu specimen shows a balance of stress and strain. Further, it may be learned that the pure Cu specimen shows a relatively high strain. This shows improvements of the BNNP/Cu specimen, about 150% of the young's modulus, about 200% of the yield strength, and about 150% of the tensile strength, when compared to the pure Cu.

TABLE 2

| | E.M. (GPa) | Y.S. (Mpa) | U.T.S (Mpa) | Elongation (%) |
|---|---|---|---|---|
| 1 vol % | 115 | 253 | 274 | 11.8 |
| 3 vol % | 147 | 307 | 378 | 0.6 |
| Pure Cu | 102 | 160 | 255 | 64.5 |

(4) Wear Resistance Evaluation

A wear resistance of the sintered body according to Example 1 was evaluated under the condition of load: 30 kg·f, distance: 1000 m, and counter material: WC-Co. and corresponding results are shown in FIG. 6 and Table 3.

TABLE 3

| BNNP | Friction Coefficient |
|---|---|
| 1.5 vol % | 0.73 |
| 2.5 vol % | 0.72 |
| 10 vol % | 0.48 |

Figure 6:
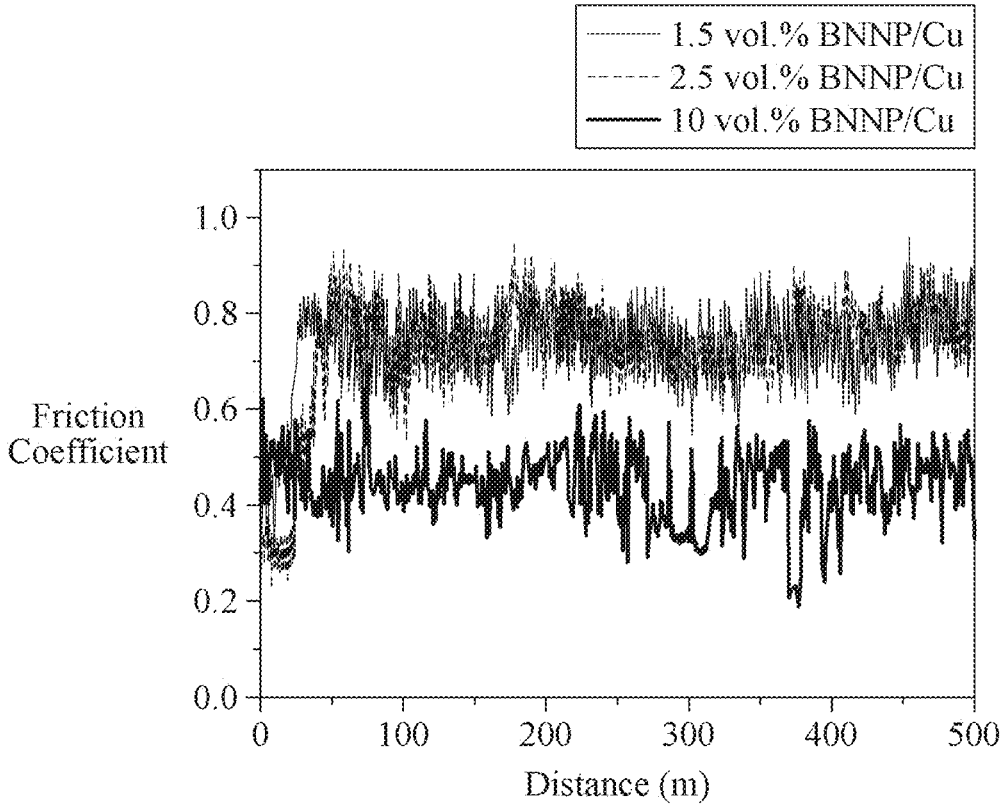
FIG. 6 illustrates a result of evaluating a wear resistance of a sintered body of a BNNP/Cu nanocomposite powder prepared in Example 1 according to an embodiment.

Referring to FIG. 6 and Table 3, it may be learned that if the molecular level mixing process is used, there is no significant difference in the friction coefficient when the BNNP content is 1.5% and when the BNNP content is 2.5%, but the friction coefficient decreases when the BNNP content is increased to 10%.

Specimens respectively with the height of 7.71 mm and 6.89 mm were prepared using the SUS440C and the sintered body of the BNNP/SUS440C nanocomposite powder of Example 2, and wear resistances thereof were evaluated under the condition of load: kg·f, distance: 500 m, and counter material: SKD, and corresponding results are shown in FIG. 7.

Figure 7:
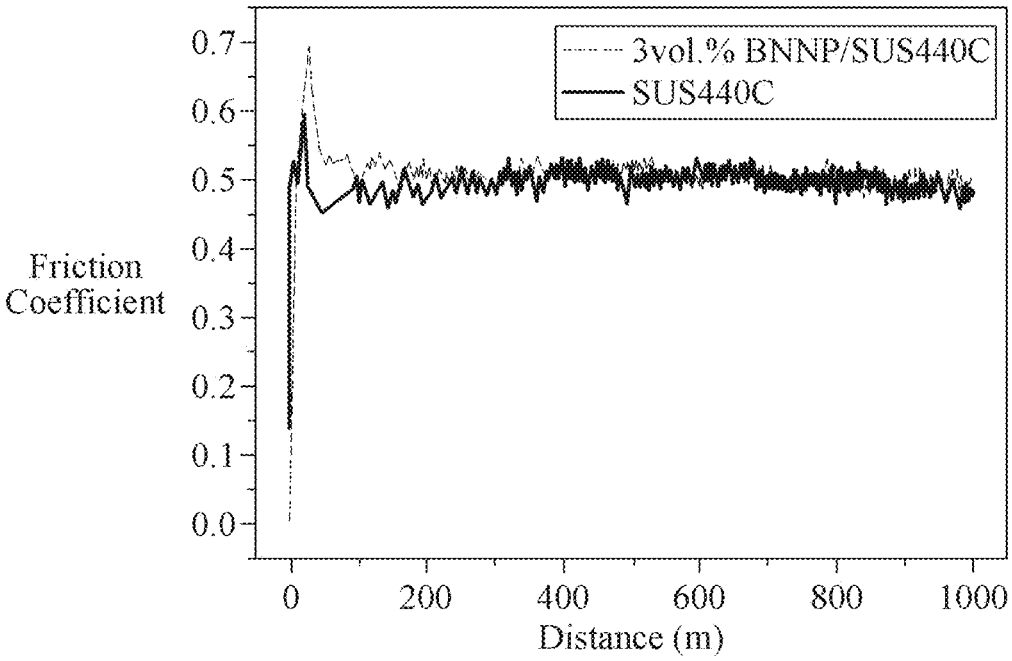
FIG. 7 illustrates a result of evaluating a wear resistance of a sintered body of a BNNP/SUS440C nanocomposite powder prepared in Example 2 according to an embodiment.

In FIG. 7, it may be learned that the BNNP/SUS440C nanocomposite powder of Example 2 shows a volume loss (Wear Rate: $1.86\times10^{-5}$ $mm^3/Nm$) of 5.469 $mm^3$, and the SUS440C shows a volume loss (Wear Rate: $4.61\times10^{-5}$ $mm^3/Nm$) of 13.558 $mm^3$. This shows that the BNNP/SUS440C nanocomposite powder of Example 2 has the wear resistance increased by 247% when compared to the SUS440C without a change in the friction coefficient by addition of BNNP.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

The invention claimed is:

1. A method of preparing a nanocomposite material comprising boron-nitride nanoplatelets (BNNP), the method comprising:

acquiring a nanocomposite powder by dispersing hexagonal BNNP within a base metal, wherein the nanocomposite powder comprises the base metal, and the hexagonal BNNP dispersed in the base metal and configured to serve as a reinforcement of the base metal, wherein the hexagonal BNNP are interposed between metal particles of the base metal in a form of a thin film of a plurality of layers and combined with the metal particles, and an amount of the hexagonal BNNP in the base metal is greater than 0 vol % and less than 90 vol %, and wherein the hexagonal BNNP have a thickness of 0.5 nm to 100 nm and a size of 1.5 μm to 10 μm.

2. The method of claim 1, wherein the base metal comprises at least one selected from the group consisting of alkali metals, alkaline earth metals, transition metals, post-transition metals, or metalloids.

3. The method of claim 1, wherein the acquiring comprising:

dispersing the hexagonal BNNP into a solvent;

providing a metal salt to be applied as the base metal to the BNNP-dispersed solvent; and forming the nanocomposite powder in which the hexagonal BNNP are dispersed in the form of the thin film of the plurality of layers between the metal particles of the base metal by reducing the hexagonal BNNP and the metal salt.

4. The method of claim 3, wherein the forming comprises returning a BNNP functional group material and the metal salt together with a reduction atmosphere or a reducer.

5. The method of claim 1, wherein the acquiring comprises:

dispersing the hexagonal BNNP into a solvent;

providing a metal salt to be applied as the base metal to the BNNP-dispersed solvent;

forming a metallic oxide by oxidizing the metal salt in the solvent; and forming the nanocomposite powder in which the hexagonal BNNP are dispersed in the form of the thin film of the plurality of layers between the metal particles of the base metal by reducing the hexagonal BNNP and the metallic oxide.

6. The method of claim 5, wherein the forming of the metallic oxide comprises performing a heat treatment after providing an oxidizer to the solvent including the BNNP and the metal salt.

7. The method of claim 5, wherein the forming of the nanocomposite powder comprises performing a heat treatment on the nanocomposite powder including the BNNP and the metallic oxide in a reduction atmosphere.

8. The method of claim 1, further comprising:

forming a bulk material by sintering the nanocomposite powder obtained during the acquiring of the nanocomposite powder at room temperature to a temperature of 90% of a melting point of the base metal.

* * * * *